US005188413A

United States Patent [19]

Nathan

[11] Patent Number: 5,188,413

[45] Date of Patent: Feb. 23, 1993

[54] BOTTLE CARRIER ASSEMBLY

[75] Inventor: Walter Nathan, Chicago, Ill.

[73] Assignee: RTC Industries, Inc., Chicago, Ill.

[21] Appl. No.: 865,057

[22] Filed: Apr. 8, 1992

[51] Int. Cl.[5] ..... B66C 1/10; B65D 71/00

[52] U.S. Cl. ..... 294/87.2; 206/151; 206/158; 206/159; 206/199; 294/159

[58] Field of Search ..... 206/145, 147, 148, 150, 206/151, 158, 159, 199, 201, 162, 139; 294/87.2, 87.28, 159

[56] References Cited

U.S. PATENT DOCUMENTS

| | | | |
|---|---|---|---|
| 2,865,669 | 12/1958 | Linthicum | 294/87.2 |
| 3,003,805 | 10/1961 | Glazer | 294/87.2 |
| 3,036,853 | 5/1962 | Glazer | 294/87.2 |
| 4,093,295 | 6/1978 | Erickson | 294/87.2 |
| 4,247,142 | 1/1981 | Erickson | 294/87.2 |

FOREIGN PATENT DOCUMENTS

| | | | |
|---|---|---|---|
| 2144334 | 3/1973 | Fed. Rep. of Germany | 294/87.2 |
| 2163344 | 2/1986 | United Kingdom | 294/87.2 |

*Primary Examiner*—Bryon P. Gehman

*Attorney, Agent, or Firm*—Dressler, Goldsmith, Shore, Sutker & Milnamow, Ltd.

[57] ABSTRACT

A unitary plastic bottle carrier assembly designed to support a plurality of bottles by their neck portions. The carrier includes split collars through which the closure and bottle neck extends and the collars support the bottles through contact with the neck ring located below the closures. The spaced split-collar assemblies are connected to a central support member and are braced relative to each other by a channel-shaped member to form a handle receiver. A handle assembly is disposed in said handle-receiving means to provide for convenient transport of the carrier and associated bottles.

3 Claims, 2 Drawing Sheets

BOTTLE CARRIER ASSEMBLY

TECHNICAL FIELD

This invention relates to a bottle carrier assembly including a novel handle arrangement capable of supporting a plurality of bottles at their neck portions.

BACKGROUND OF THE INVENTION

Various bottle carriers of this general type exist that are capable of retaining bottles at their neck portions. However, they are deficient in that they are not sufficiently compact or efficiently designed so that the carrier assembly and associated bottles can be conveniently carried. Typical of the various types of carriers referred to are disclosed in U.S. Pat. Nos. 3,633,962 and 4,093,295. Each of the carriers disclosed in the aforementioned patents is capable of carrying a plurality of bottles by their neck portions, but they do not teach the unique handling features set forth in the subject application.

SUMMARY OF THE INVENTION

The bottle carrier of the present invention can be inexpensively produced, yet it will still be sufficiently strong to support securely a plurality of bottles in spaced relationship as they are conveniently carried.

In accordance with the present invention, there is provided a novel bottle carrier assembly which includes a central support member that is capable of supporting a plurality of bottles located in split collar assemblages attached to sidewalls of the support member. The individual split collars are interconnected to each other by a unique supporting bracing means that is designed to facilitate a handle being attached to the carrier assembly to permit easy handling of the carrier and associated bottles. The handle assembly consists of end portions that can be disposed relative to the bracing means interconnecting the adjacent split collars, which handle assembly has at its end portions flexible pads which when placed in position beneath the bracing means and central support member will securely retain the handle in place during transport of the bottle carrier and associated bottles.

BRIEF DESCRIPTION OF THE DRAWINGS

The invention will be more clearly understood in conjunction with the accompanying drawings, in which.

DESCRIPTION OF THE PREFERRED EMBODIMENTS

Figure 1:
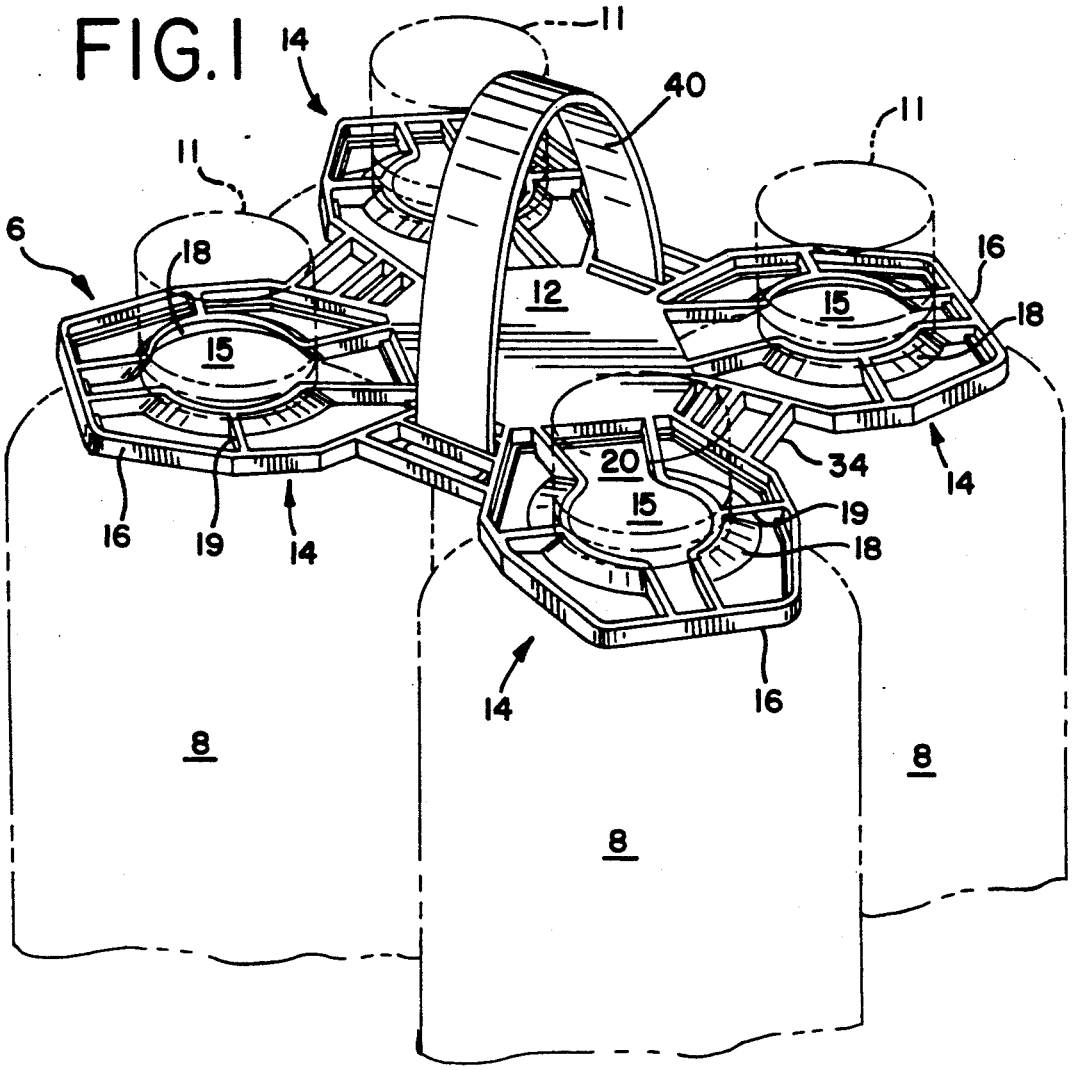
FIG. 1 is a perspective view showing the carrier assembly having bottles connected thereto.

The novel carrier assembly of the present invention is designated by the numeral 6 and consists of a plurality of split collars that are designed to receive the upper portions of bottles 8 that include a neck ring 9. The neck 10 of each bottle is supported by a separate split collar below neck ring 9 that is located below a closure 11 that is of a size to extend through a split collar. The split collar assembly is sufficiently resilient to permit the ring 9 and closure 11 to move therethrough after which it will return to its normal position to grip the neck 10 of the bottle below the closure to retain the bottle 8 in position relative to the carrier 6.

In the four-pack embodiment illustrated, there are provided four split collar assemblies 14 that are secured to a respective sidewall of the central support member 12. The central support member 12 is rigidified by cross braces 13.

Each of the split collar assemblies 14 includes an external frame portion 16 and a tapered conical section 18 that is larger at its bottom than at its top to facilitate insertion of the closure 11 and neck ring 9 and neck portion 10 of the bottle 8. Essentially, the closure, neck ring and neck portion of a bottle assembly are inserted through a split collar assembly 14, during which time, the split collar expands. When the neck ring 9 and closure 11 passes through the tapered conical section 18, the split collar assembly 14 returns to its normal position below the closure to retain the neck ring 9 of the bottle 8 in position relative to the carrier 6. The split collar assembly includes side supports 19 to help rigidify the split collar conical section 18.

Located between the central opening 15 of the conical section 18 through which the bottle neck 10 passes and the central support member 12 is an enlarged opening 20 that leads from the split ends 22 closest to the member 12 of the conical section 18 to the member 12. The split ends 22 are connected to the central support member 12 by connecting portions 24,26, which taper away from the central opening 15. Each collar also includes split ends 23 at its opposite end from the central support member 12 to provide an opening 28 directly opposite the opening 20 and leading from the opening 15 to the outer frame 16. The split ends 23 are connected to the outer frame 16 by end connections 30,32. Thus, it can be seen that there is provided a relatively rigid but flexible split collar assembly that is capable of receiving the neck ring 9 of a bottle and retain the bottle in position.

Figure 3:
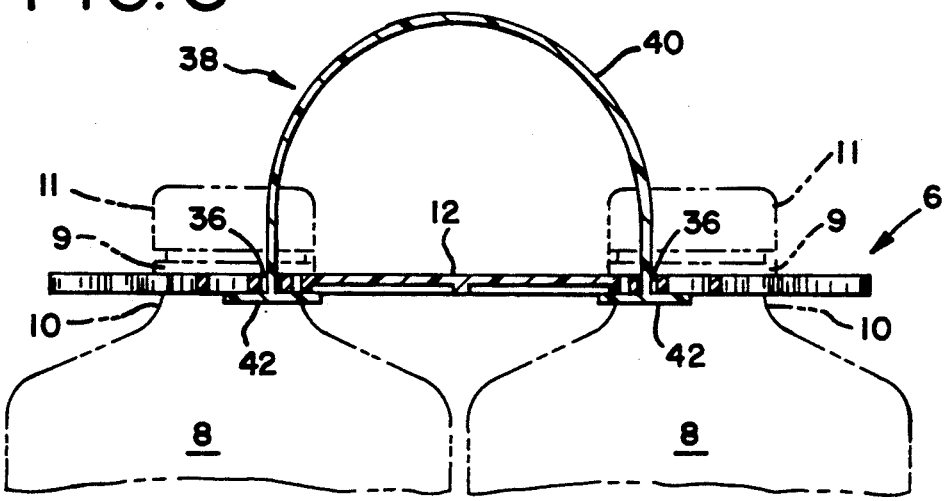
FIG. 3 is a section taken along line 3—3 of FIG. 2.
Figure 2:
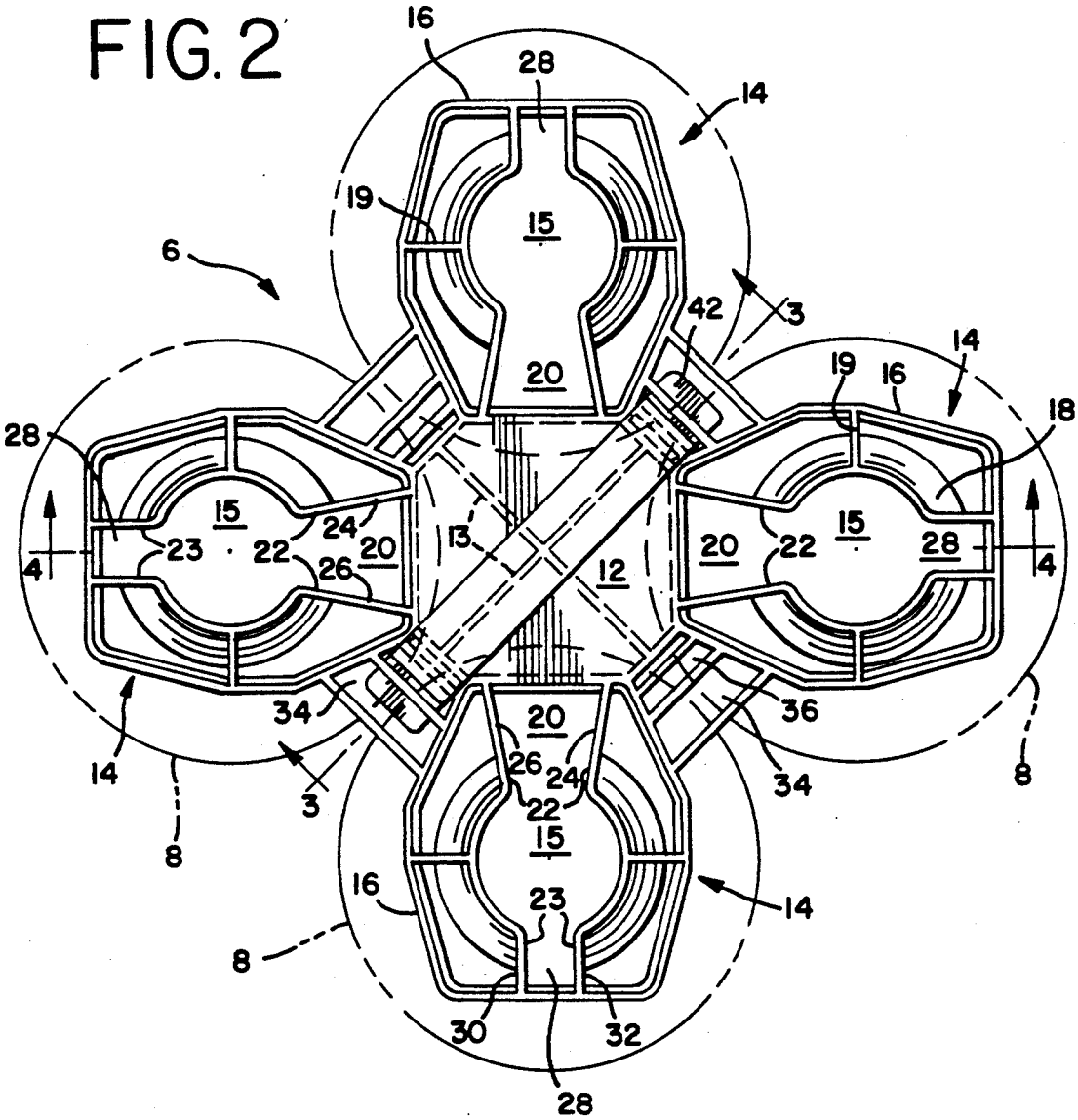
FIG. 2 is a plan view of the carrier assembly.
Figure 4:
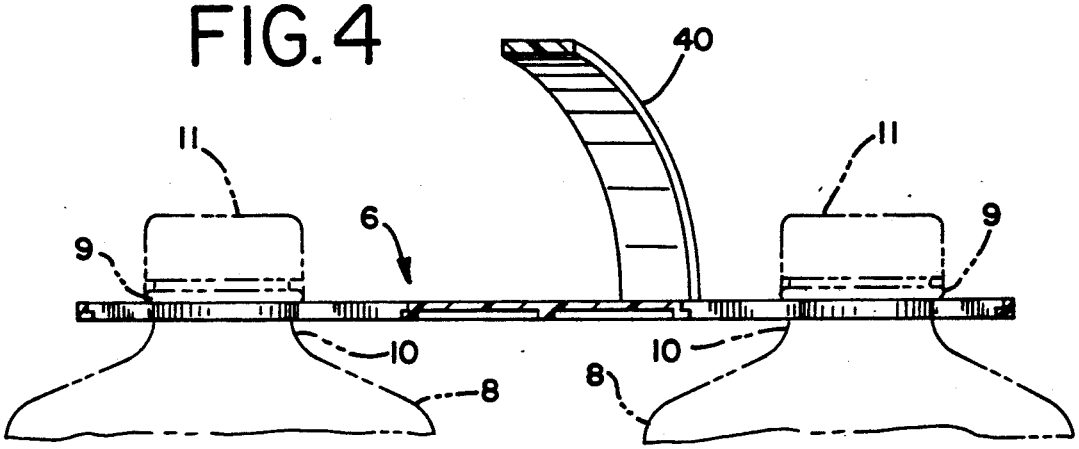
FIG. 4 is a section taken along line 4—4 of FIG. 2.

In order to provide further support for the split collars relative to each other, there is provided between adjacent split collars a channel-shaped support 34. This channel-shaped support 34 is spaced from the adjacent portion of the central support member by an opening 36. The oppositely disposed openings 36 are designed to receive the ends of a handle assembly 38. The handle assembly 38 consists of a central elongated strip 40 that has end portions in the form of rectangular pads 42 that are secured at right angles to the end of the strip 40. During the assembly of the handle to the carrier, the end pads 42 are turned parallel to the strip portion and are moved through the openings 36 after which they are flattened out as shown in FIG. 3 to prevent the handle from being removed from the carrier assembly when the carrier assembly and associated bottles are lifted.

The bottle carrier is preferably molded in one piece of a relatively inexpensive rigid flexible material, such as polyethylene. A relatively small amount of material that is properly designed produces a rigid construction whereby in accordance with the novel arrangement of the present invention the split collars will provide full support for bottles and they can be readily carried by the handle assembly connected thereto. This bottle carrier provides a very efficient and economical assembly that can be disposed of after one use.

The invention has been shown in a single preferred form which is only by way of example. While a carrier assembly for four (4) bottles has been illustrated, it is clearly within the scope of the assembly to design the carrier to handle a fewer or greater number of bottles, as desired. Of course, it is intended to cover by the appended claims all embodiments that fall within the true spirit and scope of the invention.

What is claimed is:

1. A plastic bottle carrier assembly for supporting a plurality of bottles by their necks comprising a central support member, a plurality of uniformly spaced spit collar assemblies disposed about and connected to said support member, each collar assembly consists of a frame member and resiliently supported tapered conical sections that permit the conical sections to be spaced apart for receiving and supporting therein the necks of bottles, means connecting the conical sections to the central support member and frame member, frame means for interconnecting adjacent collar assemblies consisting of a channel-shaped brace that is spaced form said central support member and defines therewith openings disposed on opposite sides of said central support member, the openings receiving end portions of a handle assembly, the end portions contacting said channel-shaped brace and central support member to secure said handle assembly relative to said carrier assembly during transport.

2. A bottle carrier assembly as set forth in claim 1 in which the handle assembly is made of a flexible plastic and consists of a narrow strip having end portions consisting of rectangular pads connected to and extending at right angles to said strip to engage the channel-shaped brace and central support member to retain the handle assembly relative to the carrier assembly.

3. A bottle carrier assembly as set forth in claim 2 in which the central support member is provided with bracing means to provide added strength.

* * * * *